US007975323B2

(12) United States Patent
Dees

(10) Patent No.: US 7,975,323 B2
(45) Date of Patent: Jul. 12, 2011

(54) FILTER FOR PREVENTING HAIR FROM BECOMING CLOGGED IN A DRAIN

(76) Inventor: Ethel J. Dees, Anthem, AZ (US)

( * ) Notice: Subject to any disclaimer, the term of this patent is extended or adjusted under 35 U.S.C. 154(b) by 406 days.

(21) Appl. No.: 12/218,611

(22) Filed: Jul. 16, 2008

(65) Prior Publication Data

US 2010/0011494 A1 Jan. 21, 2010

(51) Int. Cl.
*E03C 1/26* (2006.01)

(52) U.S. Cl. ..... 4/292

(58) Field of Classification Search ..... 4/292, 286, 4/290, 688–689, 287–289, 291, 295, 652, 4/679; 52/302.1; 210/163–164, 232, 482, 210/488–489; D23/260–261
See application file for complete search history.

(56) References Cited

U.S. PATENT DOCUMENTS

| | | | | |
|---|---|---|---|---|
| 1,494,882 | A | 5/1924 | Barger | |
| 3,742,524 | A | 7/1973 | Ballentine | |
| 4,418,432 | A | 12/1983 | Vidal | |
| 4,471,497 | A * | 9/1984 | Riutort et al. | 4/286 |
| 4,692,948 | A * | 9/1987 | Martin | 4/286 |
| 5,208,921 | A * | 5/1993 | Nicoll | 4/286 |
| 5,376,264 | A * | 12/1994 | Betancourt | 210/166 |
| D380,527 | S | 7/1997 | Velez | |
| 6,925,964 | B2 | 8/2005 | Jeffery | |

* cited by examiner

*Primary Examiner* — Lori Baker
(74) *Attorney, Agent, or Firm* — Richard L. Miller

(57) ABSTRACT

A filter for preventing hair from becoming clogged in a drain which comprises a flat annular strainer and a magnetic rim on the periphery of said flat annular strainer.

10 Claims, 3 Drawing Sheets

FILTER FOR PREVENTING HAIR FROM BECOMING CLOGGED IN A DRAIN

BACKGROUND OF THE INVENTION

1. Field of the Invention

The present invention relates to a hair preventing drain guard, and more particularly, a filter for preventing hair from becoming clogged in a drain.

2. Description of the Prior Art

Numerous innovations for various drain filters have been provided in the prior art that will be described. Even though these innovations may be suitable for the specific individual purposes to which they address, however, they differ from the present invention.

A FIRST EXAMPLE, U.S. Pat. No. 1,494,882, Issued on May 20, 1924, to Barger teaches a removable auxiliary strainer for kitchen sinks comprising a minutely perforated body portion having a dome shape center, a pair of arched resilient brace arms mounted in crossed relation upon the perforated body portion, aligned central orifices in the perforated body portion and the resilient brace arms, and a forked expansively locked fastening devices having an upper manipulating end and extending downwardly through the aligned orifices in the body portion and the resilient brace arms for assembling them over the customary perforated disk in the discharge opening to the drain pipe of a kitchen sink and with the expansible lower ends of the forked fastening device in detachable anchoring engagement with the central opening of the perforated discharge opening disk, substantially as shown and described.

A SECOND EXAMPLE, U.S. Pat. No. 3,742,524, Issued on Jul. 3, 1973, to Ballentine teaches a drain sieve adapted to fit detachably in a drain hole of a sink or the like to catch hair, preventing it from clogging traps.

A THIRD EXAMPLE, U.S. Pat. No. 4,418,432, Issued on Dec. 6, 1983, to Vidal teaches a new article of flexible and springy though rigid enough water impervious material provided with spikes or bristles or open web of crinkled filaments or rough indented openings to be installed around any conventional stopper for preventing hair, hairpins, or any other object carried away with the water flow during the taking of showers or washings or the like, from entering and clogging the drainpipes of bathtubs, lavatories and the like, through an entangling action carried out by the spikes or bristles or web or rough indented openings, and the article having a body which is shaped to be adapted to surround the lifted conventional pop-up stoppers or the like, of the drain control systems of bathtubs, lavatories and the like, and which may take any of several preferred cross section forms, such as for example, a hollow core elongated semi-cylindrical form which is integral with a flat imperforate lower portion or base, providing several preferred under surfaces or a hollow core cylindrical form, or a vertical strip-like form, or a cup-like form, or a stepped strip-like form, and the forms being constituted by a net-like structure with a plurality of openings, which in the three last mentioned cross section forms, is integral with imperforate zones and with an outwardly directed surrounding flexible flat base having a central hole defined therein and the base providing several preferred under surfaces.

A FOURTH EXAMPLE, U.S. Pat. No. 4,471,497, Issued on Sep. 18, 1984, to Riutort et al. teaches a lavatory filter for a sink drainage well that consists of a flat annular ring member having an outer circumference larger than the sink drainage well whereby the flat annular ring member will sit on top of the sink drainage well, an annular dome shaped strainer member affixed at its outer edge to the inner circumference of the flat annular ring member and a plurality of curved leaf springs each one having one end affixed to the inner circumference of the flat annular ring member below the annular dome shaped strainer member and bent downwardly to engage the inner peripheral wall surface of the sink drainage well.

A FIFTH EXAMPLE, U.S. Pat. No. 5,376,264, Issued on Dec. 27, 1994, to Betancourt teaches a drain trap apparatus for preventing the passage of debris into a drain opening which includes a disposable filter and which allows complete drainage of the wastewater. The drain trap has an annular support member which is semi-permanently attached around the drain opening. A passageway extends radially through the support member so that water will be allowed to pass through the support member. A filter, preferably of a flexible plastic mesh material, is removably attached to the support member by a plurality of hook members, such as the hook portion of a hook and loop fastener.

A SIXTH EXAMPLE, U.S. Pat. No. D380,527, Issued on Jul. 1, 1997, to Velez teaches an ornamental design for a sink drain shield, as shown and described.

A SEVENTH EXAMPLE, U.S. Pat. No. 6,925,964, Issued on Aug. 9, 2005, to Jeffery teaches an apparatus and a device for catching pet hair during the process of bathing a pet in a bathtub or sink-like structure. Typically the apparatus is comprised of a net having a selected mesh size which is stretched over the bottom of the bathtub and held in place with hooks attached to the bottom of the bathtub via integral suction cups. The device combines functional features of the apparatus into a screen for catching pet hair which is held rigid in a frame made of a pliable material which engages and grips the bottom of the bathtub and allows water to drain out to the drain of the bathtub.

It is apparent now that numerous innovations for various drain filters have been provided in the prior art that are adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a filter for preventing hair from becoming clogged in a drain that avoids the disadvantages of the prior art.

ANOTHER OBJECT of the present invention is to provide a filter for preventing hair from becoming clogged in a drain that is simple and inexpensive to manufacture.

STILL ANOTHER OBJECT of the present invention is to provide a filter for preventing hair from becoming clogged in a drain that is simple to use.

BRIEFLY STATED, STILL YET ANOTHER OBJECT of the present invention is to provide a filter for preventing hair from becoming clogged in a drain which comprises a flat annular strainer. and a magnetic rim on the periphery of said flat annular strainer.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

Figure 1:
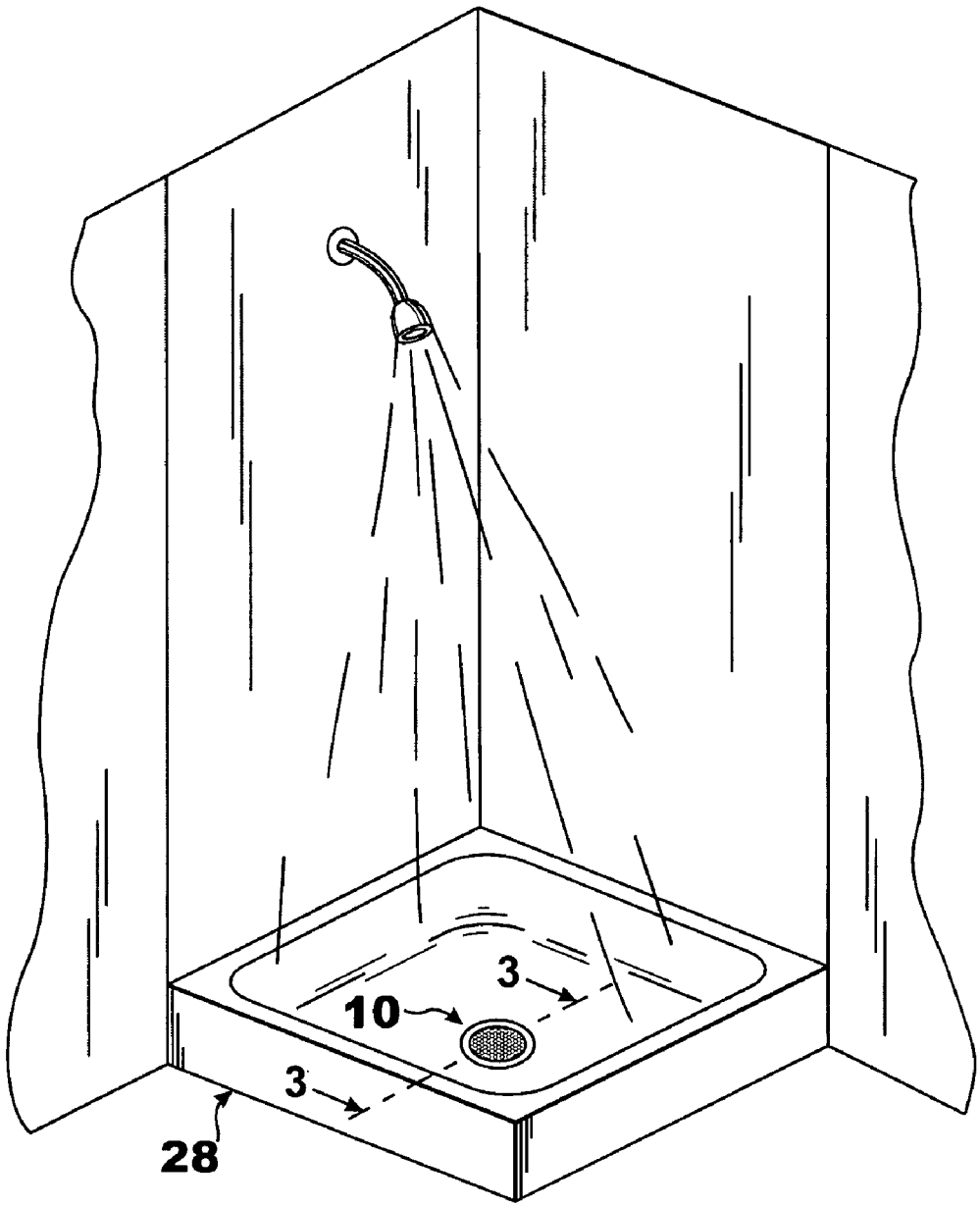
FIG. 1 is a diagrammatic perspective view of an embodiment of the present invention in use on a conventional show drain.

A Marshaling of Reference Numerals Utilized in the Drawing

10 filter
12 drain
14 flat annular strainer of filter 10
16 magnetic rim of filter 10
18 periphery of flat annular strainer 14
20 fine screen mesh material of flat annular strainer 14
22 flat magnetic ring member for magnetic rim 16
24 securing mechanism of filter 10
26 heat resistant waterproof adhesive of securing mechanism 24
28 conventional shower
30 conventional sink

DETAILED DESCRIPTION OF THE PREFERRED EMBODIMENT

Figure 2:
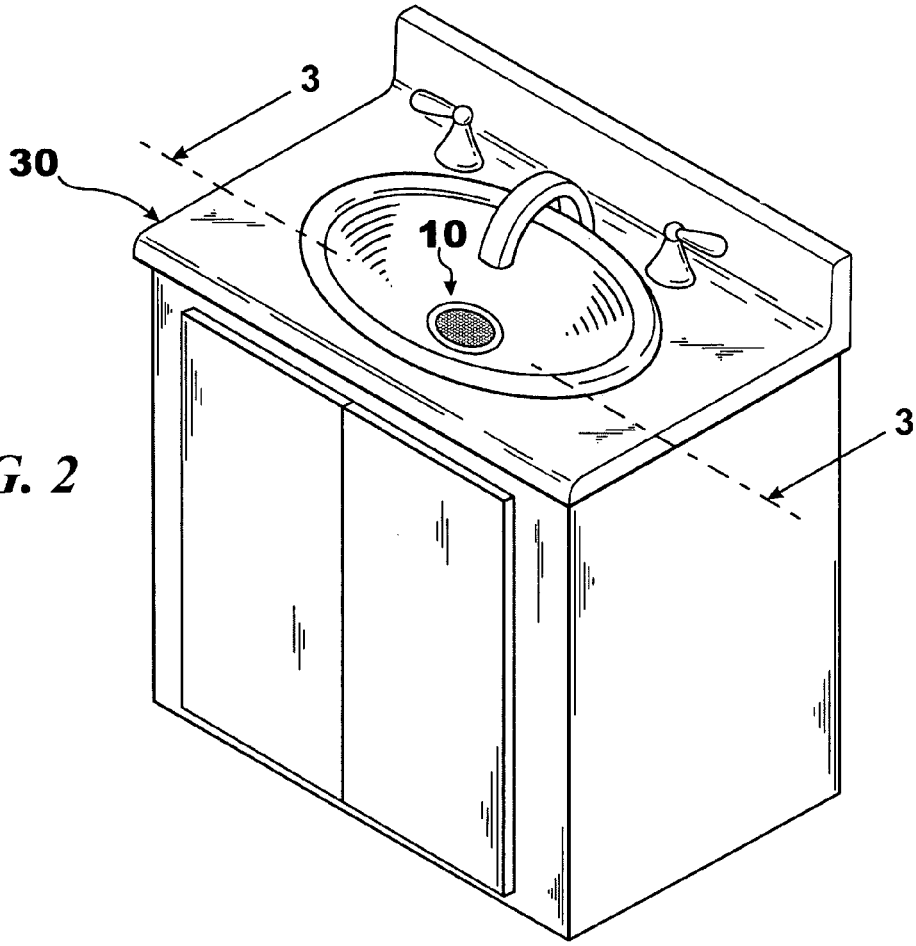
FIG. 2 is a diagrammatic perspective view of an embodiment of the present invention in use on a conventional sink drain.
Figure 3:
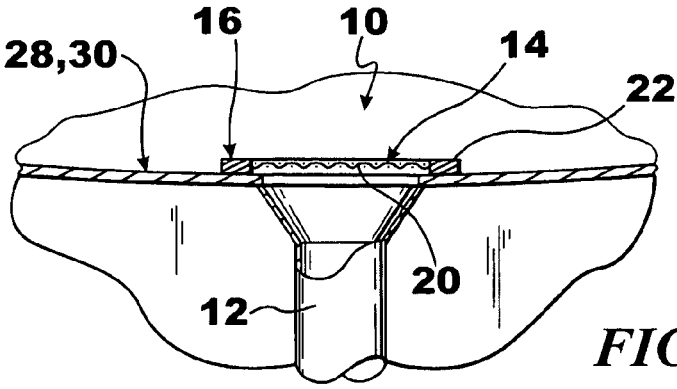
FIG. 3 is a diagrammatic cross-sectional view taken on lines 3-3 of FIGS. 1 and 2.
Figure 4:
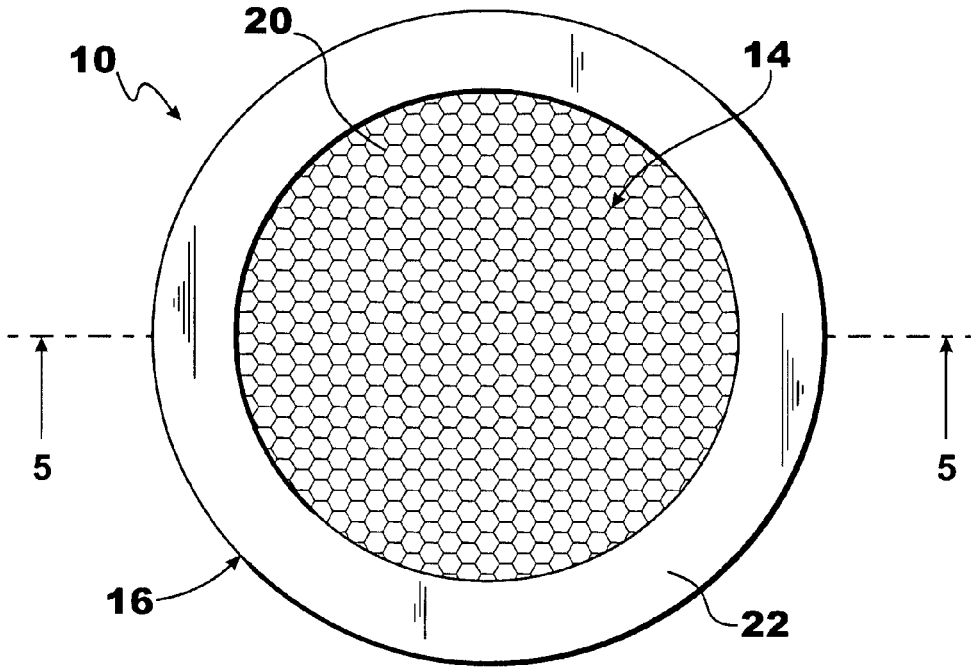
FIG. 4 is a diagrammatic enlarged top elevational view of the present invention per se.
Figure 5:
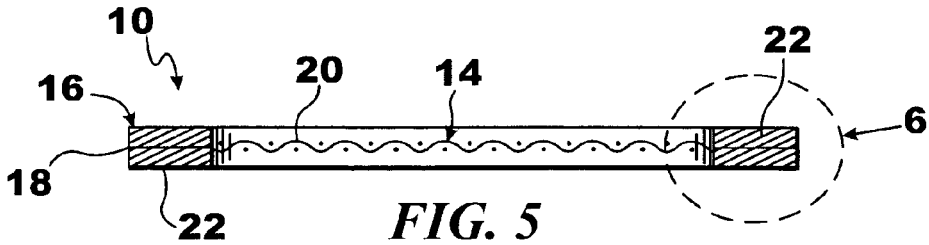
FIG. 5 is a diagrammatic cross sectional view taken on line 5-5 of FIG. 4.

Referring now to the figures, in which like numerals indicate like parts, and particularly to FIGS. 1 through 6, which are a diagrammatic perspective view of an embodiment of the present invention in use on a typical shower drain; a diagrammatic perspective view of the present invention in use on a typical sink drain; a diagrammatic cross-sectional view taken on lines 3-3 of FIGS. 1 and 2; a diagrammatic enlarged top elevational view of the present invention per se; a diagrammatic cross sectional view taken on line 5-5 of FIG. 4; and an enlarged diagrammatic cross sectional view taken in the area enclosed in the dotted circle indicated by arrow 6 in FIG. 5 illustrating the typical construction in greater detail, and as such, will be discussed with reference thereto.

The present invention is a filter 10 for preventing hair from becoming clogged in a drain 12 which comprises a flat annular strainer 14, and a magnetic rim 16 on the periphery 18 of the flat annular strainer 14.

The flat annular strainer 14 comprises a fine screen mesh material 20. The magnetic rim 16 comprises a flat magnetic ring member 22, as shown in FIG. 3. The flat magnetic ring member 22 can be comprised of a rust proof metal magnetic material, a plastic magnetic material or a sintered magnetic material.

Figure 6:
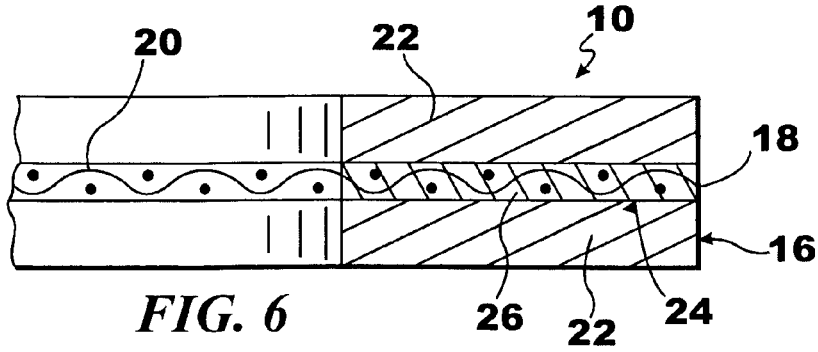
FIG. 6 is an enlarged diagrammatic cross sectional view taken in the area enclosed in the dotted circle indicated by arrow 6 in FIG. 5 illustrating the typical construction in greater detail.

The magnetic rim 16 comprises a pair of flat magnetic ring members 22, as shown in FIGS. 5 and 6. Each flat magnetic ring member 22 is comprised of a rust proof metal magnetic material, a plastic magnetic material, or a sintered magnetic material.

The filter 10, as best seen in FIG. 6, further comprises a mechanism 24 for securing the periphery 18 of the flat annular strainer 14 between the pair of flat magnet ring members 22. The securing mechanism 24 is comprised of a heat resistant waterproof adhesive material 26.

The filter 10 can be used on the drain 12 of a conventional shower 28, as show in FIG. 1. The filter 10 can also be used on the drain 12 of a conventional sink 30, as shown in FIG. 2.

It will be understood that each of the elements described above, or two or more together, may also find a useful application in other types of constructions differing from the types described above.

While the invention has been illustrated and described as embodiments of a filter for preventing hair from becoming clogged in a drain, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A filter for preventing hair from becoming clogged in a drain which comprises:

a) a flat annular strainer having a periphery;

b) a magnetic rim on the said periphery of said flat annular strainer; wherein said magnetic rim comprises a pair of flat magnetic ring members; and c) means for securing the periphery of said flat annular strainer between said pair of flat magnetic ring members.

2. The filter as recited in claim 1, wherein said flat annular strainer comprises a fine screen mesh material.

3. The filter as recited in claim 1, wherein said magnetic rim comprises a flat magnetic ring member.

4. The filter as recited in claim 3, wherein said flat magnetic ring member is comprised of a rust proof metal magnetic material.

5. The filter as recited in claim 3, wherein said flat magnetic ring member is comprised of a plastic magnetic material.

6. The filter as recited in claim 3, wherein said flat magnetic ring member is comprised of a sintered magnetic material.

7. The filter as recited in claim 1, wherein each said flat magnetic ring member is comprised of a rust proof metal magnetic material.

8. The filter as recited in claim 1, wherein each said flat magnetic ring member is comprised of a plastic magnetic material.

9. The filter as recited in claim 1, wherein each said flat magnetic ring member is comprised of a sintered magnetic material.

10. The filter as recited in claim 1, wherein said securing means is comprised of a heat resistant waterproof adhesive material.

* * * * *